United States Patent [19]

Valiga et al.

[11] Patent Number: 4,930,831

[45] Date of Patent: Jun. 5, 1990

[54] SIDE EXTENSION FOR A TOY WAGON

[75] Inventors: Richard A. Valiga, Bartlett; Richard S. Hart, Elgin, both of Ill.

[73] Assignee: Radio Flyer Inc., Chicago, Ill.

[21] Appl. No.: 282,375

[22] Filed: Dec. 9, 1988

[51] Int. Cl.[5] ..... B62B 3/02

[52] U.S. Cl. ..... 296/26; 296/10; 280/47.34; 280/79.2; 280/87.01; D21/76

[58] Field of Search ..... 296/26, 10, 32, 43; 280/47.18, 47.34, 87.01, 79.2; D21/76

[56] References Cited

U.S. PATENT DOCUMENTS

| | | | |
|---|---|---|---|
| 2,394,248 | 2/1946 | McCray | 280/87.01 |
| 2,676,054 | 4/1954 | Pasin | 296/43 |
| 3,075,801 | 1/1963 | Silver | 296/26 |
| 3,220,773 | 11/1965 | Burns | 280/79.2 |
| 4,796,909 | 1/1989 | Kirkendall | 296/26 |

*Primary Examiner*—Robert R. Song

*Attorney, Agent, or Firm*—James P. Ryther

[57] ABSTRACT

The side extension of the invention includes first and second extension wall portions each circumscribing one-half of the area defined by the upstanding walls of the wagon body. The side extensions have a groove which is engaged by a lip extending from and disposed substantially perpendicular to the upstanding walls. The first and second extension wall portions have coupling elements formed at each end thereof which are secured to one another by bolts to lock the side extension on the wagon. The side extension when mounted on the wagon extends beyond the upstanding walls of the wagon body to increase the depth of the passenger department.

13 Claims, 3 Drawing Sheets

SIDE EXTENSION FOR A TOY WAGON

BACKGROUND OF THE INVENTION

The invention relates, generally, to toy wagons and, more particularly, to a side extension which can be removably mounted to the wagon to provide a deeper passenger compartment.

The typical toy wagon includes a wagon body having a planar bottom portion and an integrally formed wall extending upwardly from the bottom portion to form a passenger compartment for carrying a child. The wagon body is supported on front and back wheel assemblies which provide rolling contact with the ground. The back wheel assembly consists of a pair of wheels rotatably supported on an axle which is fixed to the wagon body. The front wheel assembly includes a pair of wheels rotatably supported on an axle which is mounted to the wagon body for pivotal movement. A handle is connected to the axle of the front wheel assembly for pivoting the wheel assembly such that steering can be effected.

In conventional wagon design, the upwardly extending walls are relatively low such that the passenger compartment is fairly shallow. While this design is suitable for carrying children, higher walls are preferred in some cases, for example when hauling large or cumbersome loads.

As a result, it is desirable to provide a wagon with a deeper passenger compartment in order to maximize the wagon's utility. In addition, it is desirable to be able to operate the wagon in either the conventional configuration or with the modified deeper passenger compartment.

BRIEF DESCRIPTION OF THE INVENTION

The side extension of the invention provides the desired features by providing an attachment for use with conventional wagons which can be simply and easily secured to the walls of a conventional wagon body. The invention makes it possible for the end user to convert a conventional wagon into a wagon having higher walls and larger capacity. Moreover, the side extension can be easily removed from the wagon body to restore the wagon to the conventional configuration.

The side extension includes first and second extension wall portions each circumscribing one-half of the area defined by the wall of the wagon body and having a groove which is engaged by a horizontally extending lip formed integrally with the wall. The end portions of the first and second extension wall portions are secured to one another to mount the side extension on the wall such that it extends beyond the edge of the wagon body wall to thereby increase the depth of the passenger compartment.

OBJECTS OF THE INVENTION

It is a general object of the invention to provide a side extension for use with a conventional toy wagon which increases the depth of the passenger compartment.

It is another object of the invention to provide a side extension able to be releasably secured to a toy wagon such that the end user can quickly and easily install and remove the side extension.

It is a further object of the invention to provide a side extension which, once installed on a wagon, is securely locked in position.

Other objects of the invention, in addition to those set forth above, will become apparent from the following detailed description.

DETAILED DESCRIPTION OF THE INVENTION

Figure 1:
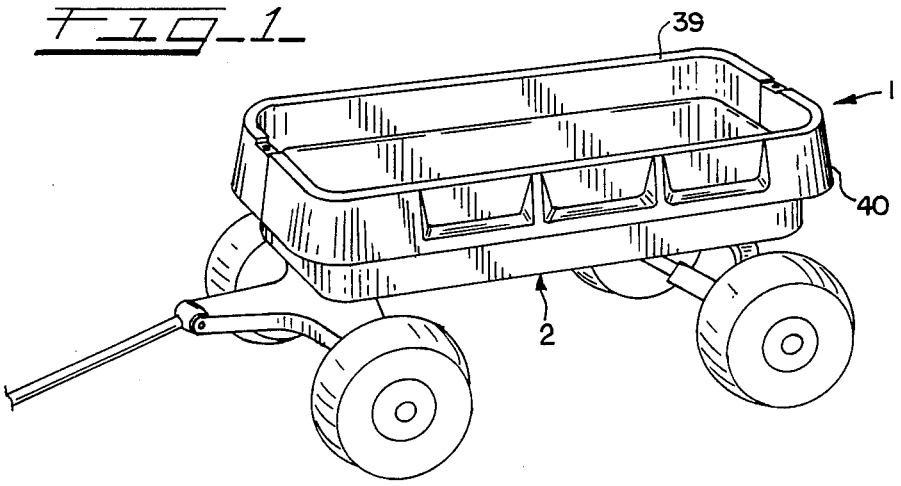
FIG. 1 shows a perspective view of the preferred embodiment of the invention mounted on a conventional toy wagon.
Figure 2:
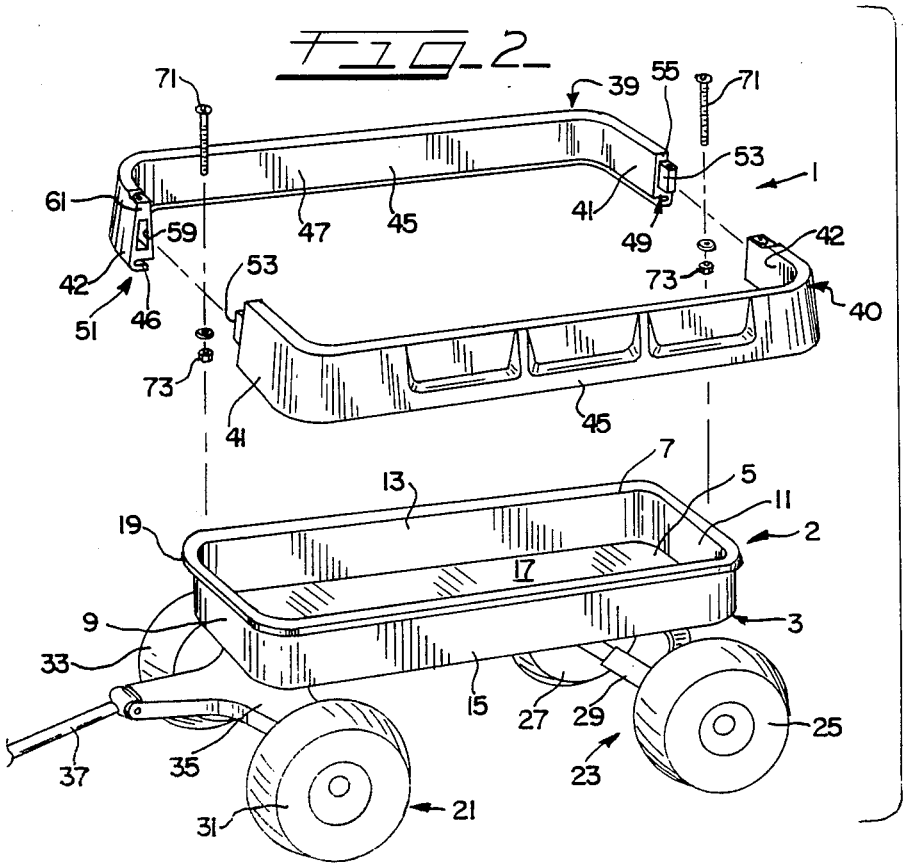
FIG. 2 shows an exploded view of the assembly of FIG. 1.
Figure 4:
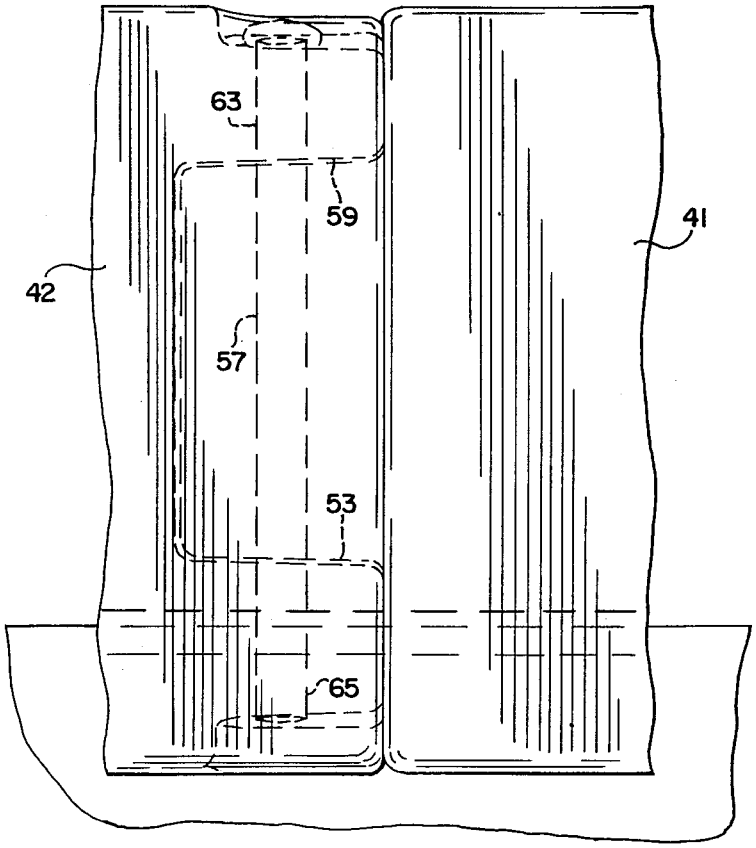
FIG. 4 shows a partial end view of the assembly shown in FIG. 1.

FIG. 1 shows the side extension of the invention 1 mounted on a conventional toy wagon 2. The wagon 2 is best illustrated in FIG. 2 and includes a wagon body 3 having a planar bottom portion 5 and a wall 7 extending upwardly from the bottom portion 5 and disposed substantially perpendicularly thereto to form passenger compartment 17. The wall 7 consists of a front portion 9, back portion 11, and side portions 13 and 15. A lip 19 is formed about the periphery of wall 7 and extends substantially perpendicularly thereto.

The wagon body 3 is supported on a front wheel assembly 21 and rear wheel assembly 23 providing rolling engagement with the ground. The rear wheel assembly 23 includes wheels 25 and 27 rotatably mounted on fixed axle 29. The front wheel assembly 21 includes wheels 31 and 33 mounted on axle 35. Axle 35 is pivotally connected to the wagon body and has a handle 37 pivotally attached thereto such that steering of the wagon can be effected.

The side extension 1 includes a pair of extension wall portions 39 and 40. The extension wall portions 39 and 40 are identical to one another and are made, preferably, of a rigid molded plastic material, although other suitable materials may be used. The extension wall portions include a pair of connecting portions 41 and 42 formed integrally with and secured together by an elongated center portion 45. Center portions 45 of the extension wall portions 39 and 40 are dimensioned so as to extend for the length of side portions 13 and 15, respectively, and connecting portions 41 and 43 are dimensioned so as to extend for approximately one-half of the length of front portion 9 and back portion 11. A groove 46 is formed in the inside surface 47 of the extension wall portions 39 and 40 near the bottom edges thereof and extends for the length thereof.

Connecting portion 41 terminates in a first coupling element 49 and connecting portion 42 terminates in a second coupling element 51 such that the first and second coupling elements of extension wall portion 39 mateably engage the first and second coupling elements of extension wall portion 40 when the side extension 1 is mounted on wagon body 3. The first coupling element 49 defines a tenon 53 extending from face 55 of connecting portion 41. A bolt hole 57 is formed in tenon 53 and extends completely therethrough as best shown in FIG.

Figure 3:
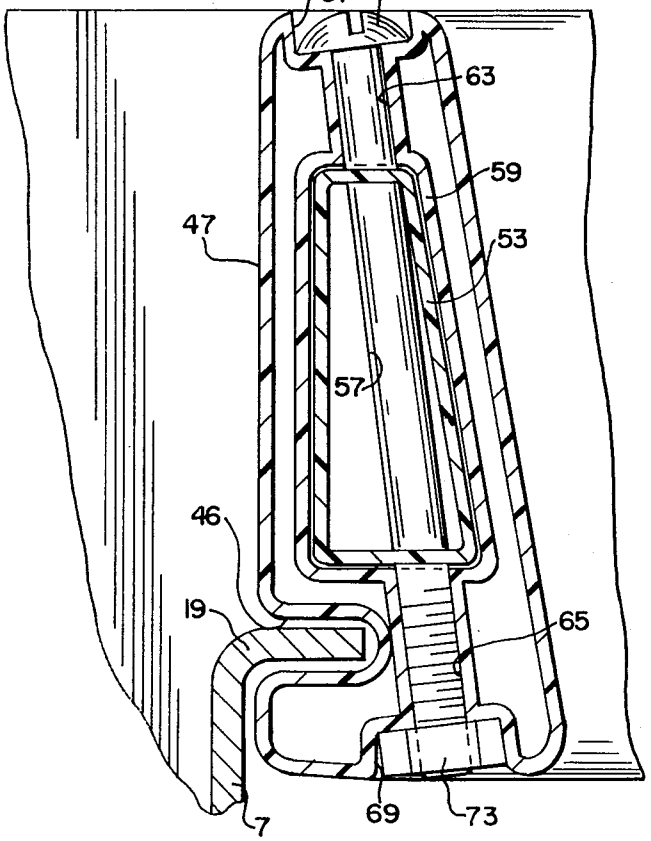
FIG. 3 shows a partially cut-away side view showing the connection between the extension wall portions of the assembly of FIG. 1.

3. The second coupling element 51 defines a mortise 59 formed in substantially the center of face 61. Mortise 59 is shaped and dimensioned so as to closely receive tenon 53. Bolt holes 63 and 65 are formed in connecting portion 42 such that they will be aligned with bolt hole 57 when the extension wall portions are mounted on the wagon body 3 as best shown in FIG. 3. Recesses 67 and 69 are formed in the upper and lower surfaces of connecting portion 42 for receiving the head of a bolt and a nut, respectively, as will hereinafter be described.

In order to mount the side extension 1 on wagon 2, extension wall portion 39 is placed against one side of the wagon body 3 such that groove 46 is engaged by lip 19 and center portion 45 is coextensive with side portion 13. The other extension wall portion 40 is positioned against the wagon body 3 such that its associated groove is engaged by lip 19 and its mortise and tenon are engaged by the tenon and mortise of the first extension wall portion 39. Bolts 71 are inserted through the aligned bolt holes 57, 63 and 65 and are secured therein by nuts 73. As best illustrated in FIG. 7, the bolt heads 75 and nuts 73 are located within recesses 67 and 69 such that these elements do not protrude beyond the surface of side extension 1. As is evident from the foregoing description, the side extension 1 is "locked" into position by the engagement of lip 19 with groove 46 yet can be easily removed from the wagon body by simply removing bolts 71.

Figure 5:
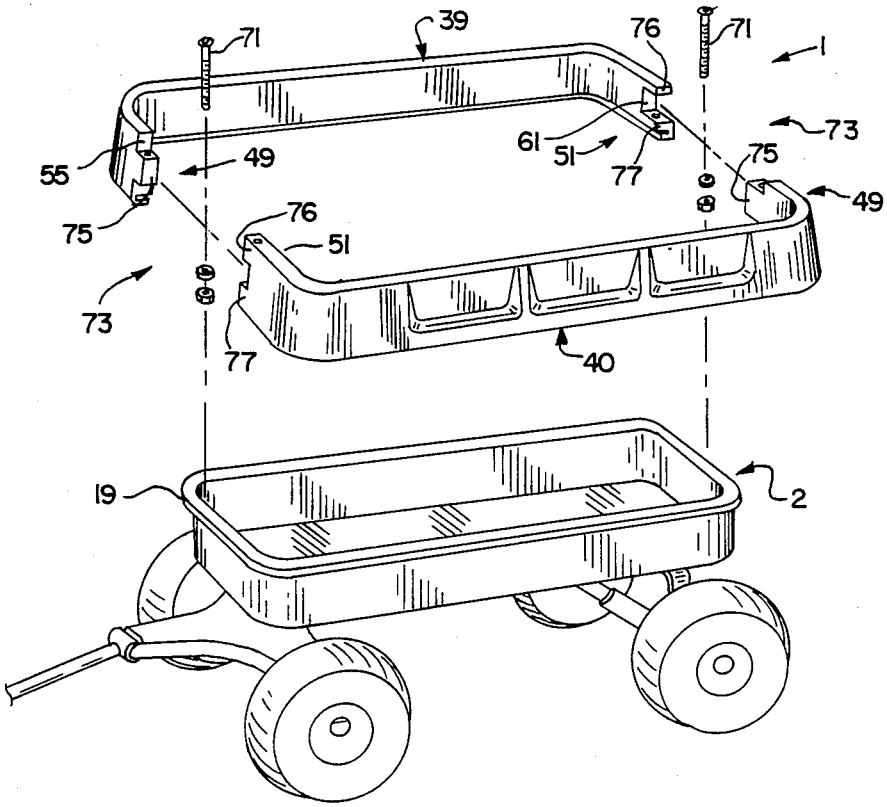
FIG. 5 shows a perspective view of a second embodiment of the connection between the extension wall portions.
Figure 6:
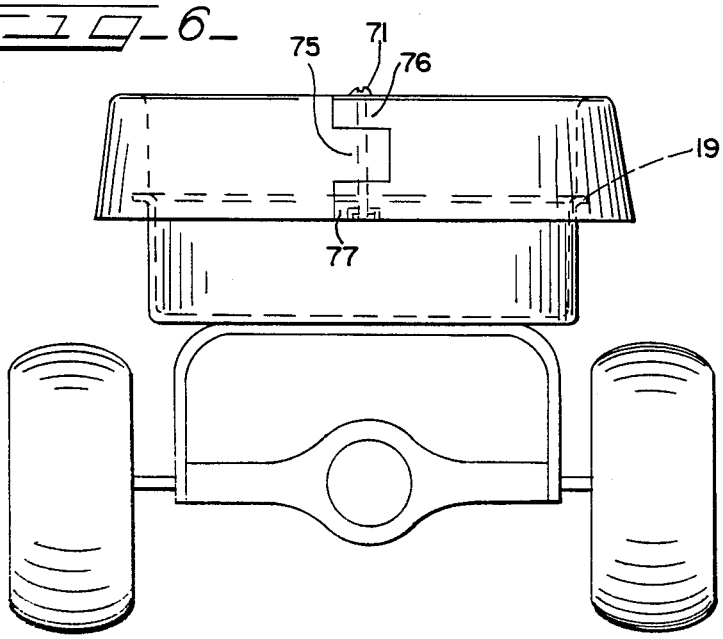
FIG. 6 shows an end view of the embodiment illustrated in FIG. 5.

A second embodiment of the invention is illustrated in FIG. 5, where like numerals represent like components described with reference to the preferred embodiment, and is identical to that already shown and described except for the configuration of coupling elements 49 and 51. The mortise and tenon arrangement of the preferred embodiment has been replaced by the interdigitated members shown at 73 in FIG. 5. Specifically, connecting element 49 includes a first member 75 extending from face 55 and located centrally thereon. The mating connecting element 51 includes two interdigitating members 76 and 77 extending from face 61 and spaced from one another so as to snugly receive the first interdigitating member 75. Bolt holes are formed through the interdigitating members such that bolts 71 may be inserted therethrough to lock the side extension on the wagon body 3. It is possible to provide recesses in interdigitating members 76 and 77 to receive the bolt heads and nuts as was explained with reference to the preferred embodiment.

Although the invention has been described with a certain degree of particularity, it is to be understood that changes in the details of construction and arrangement of parts may be made without departing from the spirit and scope of the invention.

What is claimed is:

1. A side extension for use with a conventional toy wagon of the type having a planar bottom portion and an upstanding wall having a perimeter defined by front, back and side port is extending from said bottom portion to define a passenger compartment, the side extension comprising means for increasing the depth of the passenger compartment and including:

(a) a first extension wall portion mounted to a portion of said perimeter and extending upwardly beyond the front, back and side portions;

(b) a second extension wall portion mounted to another portion of said perimeter and extending upwardly beyond the front back and side portions;

(c) wherein a lip is defined by said perimeter, and wherein said first and second extension wall portions include means for engaging the lip;

(d) said means for engaging said lip comprising a groove defined by the respective wall portions into which said lip is inserted; and (e) means for securing the first extension wall portion to the second extension wall portion such that said side extension circumscribes the area defined by the front, back, and side portions to thereby increase the depth of the passenger compartment.

2. The side extension according to claim 1, wherein said securing means includes coupling members mateably engageable with one another and a fastening means for securing said coupling members to one another.

3. The side extension according to claim 2, wherein said first and second extension wall portions each have a first and second end face, said coupling members being located on said first and second end faces.

4. A side extension for use with a conventional toy wagon of the type having a planar bottom portion and an upstanding wall having a perimeter defined by front, back and side portions extending from said bottom portion to define a passenger compartment, the side extension comprising means for increasing the depth of the passenger compartment and including:

(a) a first extension wall portion mounted to a portion of said perimeter and extending upwardly beyond the front, back and side portions;

(b) a second extension wall portion mounted to another portion of said perimeter and extending upwardly beyond the front, back and side portions;

(c) a lip defined by said perimeter, and wherein said first and second extension wall portions include means for engaging the lip;

(d) means for securing the first extension wall portion to the second extension wall portion such that said side extension circumscribes the area defined by the front, back, and side port is to thereby increase the depth of the passenger compartment, said securing means including coupling members mateably engageable with one another and a fastening means for securing said coupling members to one another; and, (e) wherein said first and second extension wall portions each have a first and second end face, said coupling members being located on said first and second end faces, the coupling members on said first end faces including a mortise and the coupling members on said second end faces including a tenon, said first and second extension wall portions being disposed on said wagon such that said first faces abut said second faces.

5. The end extension according to claim 4, wherein the mortises and tenons define bolt holds such that a bolt may be inserted therethrough to secure the first extension wall portion to the second extension wall portion.

6. The end extension according to claim 4, wherein the coupling member on said first end faces includes a first member extending therefrom and centrally located thereon, and the coupling member on said second end races includes second and third members extending therefrom and located thereon such that said second and third members receive said first member therebetween.

7. The end extension according to claim 6, wherein said first, second, and third members define bolt holes such that a bolt may be inserted therethrough to secure the first extension wall portion to the second extension wall portion.

8. A side extension for use with a conventional toy wagon of the type having a planar bottom portion and an upstanding wall having a perimeter defined by front, back and side portions extending from said bottom portion to define a passenger compartment, the side extension comprising means for increasing the depth of the passenger compartment and including:

(a) a first extension wall portion;

(b) a second extension wall portion;

(c) means for mounting said first and second extension wall portions to portions of said perimeter such that the first and second extension wall portions extend upwardly beyond the front, back and side portions; said means for mounting including a lip defined by said perimeter and a means for engaging said lip formed on said first and second extension wall portions, said engaging means including a groove into which said lip is inserted; and, (d) means for securing the first extension wall portion to the second extension wall portion such that said side extension circumscribes the area defined by the front, back and side portions to thereby increase the depth of the passenger compartment.

9. A side extension for use with a conventional toy wagon of the type having a planar bottom portion and an upstanding wall having a perimeter defined by front, back and side portions extending from said bottom portion to define a passenger compartment, the side extension comprising means for increasing the depth of the passenger compartment and including:

(a) a first extension wall portion;

(b) a second extension wall portion;

(c) means for mounting said first and second extension wall portions to portions of said perimeter such that the first and second extension wall portions extend upwardly beyond the front, back and side portions;

(d) means for securing the first extension wall portion to the second extension wall portion such that said side extension circumscribes the area defined by the front, back and side portions to thereby increase the depth of the passenger compartment; and, (e) said first and second extension wall portions each having a first and second end face, said securing means being located on said first and second end faces, the securing means on said first end faces including a mortise and the securing means on said second end faces including a tenon, said first and second extension wall portions being disposed on said wagon such that said first faces abut said second faces.

10. The side extension according to claim 9, wherein the mortises and tenons define bolt holes such that a bolt may be inserted therethrough to secure the first extension wall portion to the second extension wall portion.

11. A side extension for use with a conventional toy wagon of the type having a planar bottom portion and an upstanding wall having a perimeter defined by front, back and side portions extending from said bottom portion to define a passenger compartment, the side extension comprising means for increasing the depth of the passenger compartment and including:

(a) a first extension wall portion;

(b) a second extension wall portion;

(c) means for mounting said first and second extension wall portions to portions of said perimeter such that the first and second extension wall portions extend upwardly beyond the front, back and side portions;

(d) means for securing the first extension wall portion to the second extension wall portion such that said side extension circumscribes the area defined by the front, back and side portions to thereby increase the depth of the passenger compartment; and, (e) said first and second extension wall portions each having a first and second end face, said securing means being located on said first and second end faces, the securing means on said first end faces including a first member extending therefrom and centrally located thereon, and the securing means on said second end faces including second and third members extending therefrom and located thereon such that said second and third members receive said first member therebetween.

12. The side extension according to claim 11, wherein said first, second, and third members define bolt holes such that a bolt may be inserted therethrough to secure the first extension wall portion to the second extension wall portion.

13. A toy wagon in combination with a side extension for use with the wagon, said wagon being of the type having a planar bottom portion and an upstanding wall having a perimeter defined by front, back and side portions extending from said bottom portion to define a passenger compartment, the side extension comprising means for increasing the depth of the passenger compartment and including:

(a) a first extension wall portion;

(b) a second extension wall portion;

(c) means for mounting said first and second extension wall portions to portions of said perimeter such that the first and second extension wall portions extend upwardly beyond the front, back and side portions;

(d) said means for mounting including first locking means defined by said perimeter and extending lengthwise thereof, and second locking means defined by the respective extension wall portions in a secure relationship with said first and second locking means holding said respective extension wall portions in a secure relationship with said wagon; and, (e) means for securing the first extension wall portion to the second extension wall portion such that said side extension circumscribes the area defined by the front, back and side portions to thereby increase the depth of the passenger compartment.

* * * * *